US005552169A

United States Patent [19]

Kannankeril et al.

[11] Patent Number: 5,552,169

[45] Date of Patent: Sep. 3, 1996

[54] FOOD PACKAGE ADAPTED FOR MICROWAVE OR OTHER COOKING

[75] Inventors: Charles P. Kannankeril, North Caldwell, N.J.; Carol A. Norris, Lenoir, N.C.

[73] Assignee: Sealed Air Corporation, Saddle Brook, N.J.

[21] Appl. No.: 807,267

[22] Filed: Dec. 13, 1991

Related U.S. Application Data

[63] Continuation-in-part of Ser. No. 691,218, Apr. 25, 1991, abandoned.

[51] Int. Cl.[6] ..... B65D 85/00

[52] U.S. Cl. ..... 426/107; 206/204; 426/124; 426/129; 426/234; 426/237; 426/243

[58] Field of Search ..... 426/124, 129, 426/107, 243, 234, 396, 106, 109, 110, 112, 113, 127, 237, 241, 392; 206/204

[56] References Cited

U.S. PATENT DOCUMENTS

| | | | |
|---|---|---|---|
| 4,390,554 | 6/1983 | Levinson | 426/232 |
| 4,410,578 | 10/1983 | Miller | 426/124 |
| 4,645,698 | 2/1987 | Matsubara | 426/112 |
| 4,720,410 | 1/1988 | Lundquist et al. | 426/107 |
| 4,786,513 | 11/1988 | Monforton et al. | 426/107 |
| 4,857,342 | 8/1989 | Kappes | 426/107 |
| 4,935,276 | 6/1990 | Pawlowski et al. | 426/107 |
| 4,940,621 | 7/1990 | Rhodes et al. | 426/124 |
| 4,950,524 | 8/1990 | Hacker | 426/107 |

*Primary Examiner*—Leslie Wong
*Attorney, Agent, or Firm*—Bell, Seltzer, Park & Gibson, P.A.

[57] ABSTRACT

A food package and absorbent pad adapted for microwave or conventional oven cooking of food products by being formed of high temperature resistant, heat sealable materials and by the pad being capable of absorbing water, juices and the like and fats, oils or greases simultaneously without hindering the absorption of the other, and in which the liquid permeability of the pad may be controlled depending upon the characteristics of the food product. The pad includes upper and lower layers, and an intermediate layer of absorbent material, one or both of the upper and lower layers may be of varying liquid permeability.

20 Claims, 2 Drawing Sheets

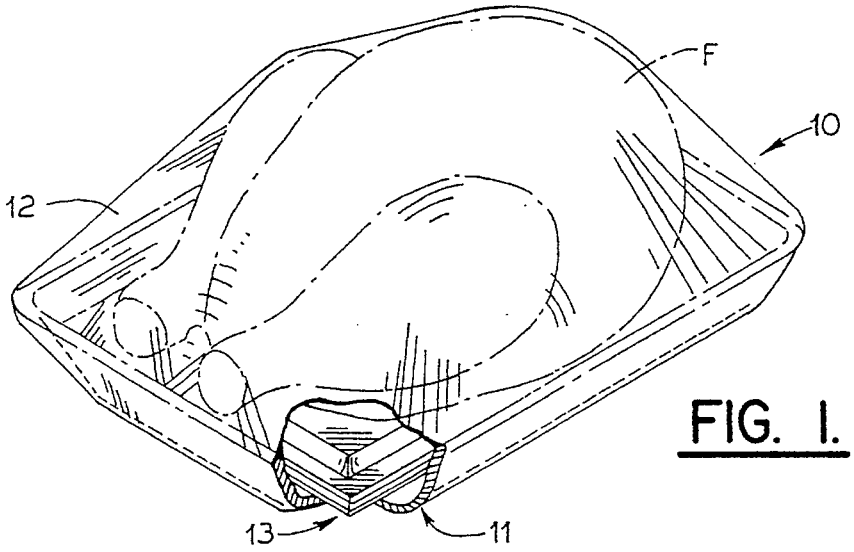
FIG. 1.
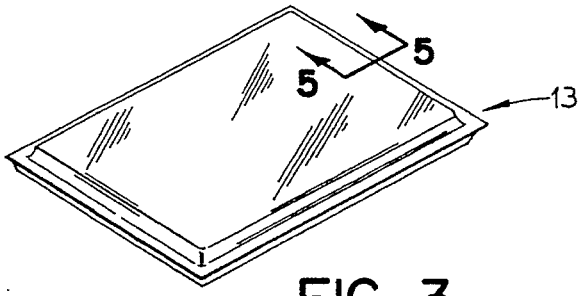
FIG. 3.
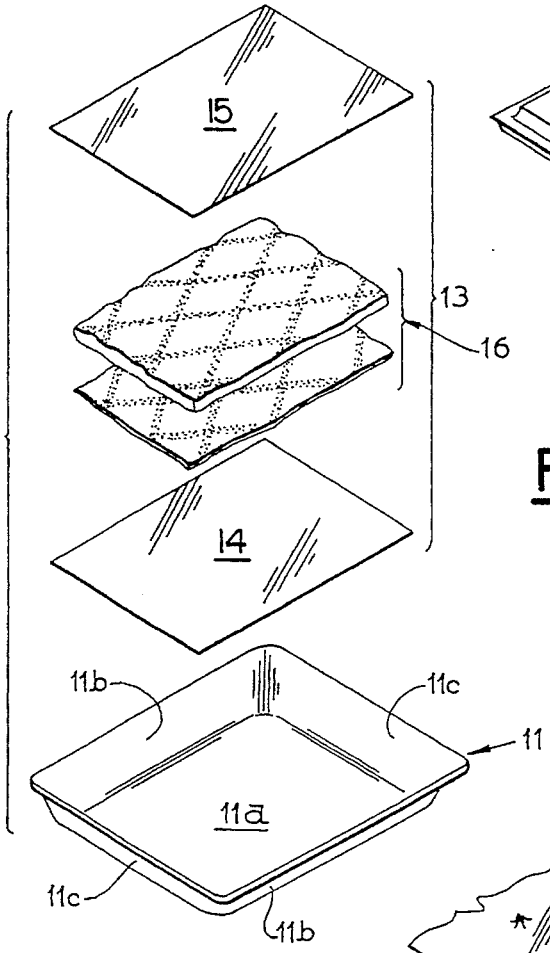
FIG. 2.
FIG. 4.
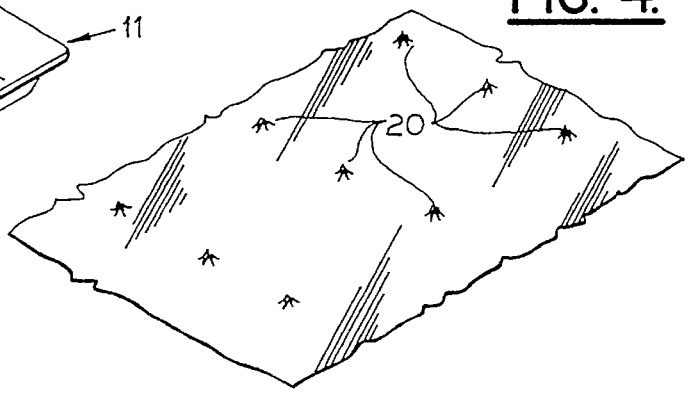

FOOD PACKAGE ADAPTED FOR MICROWAVE OR OTHER COOKING

CROSS REFERENCE TO RELATED APPLICATION

This application is a continuation-in-part application of Ser. No. 691,218 filed Apr. 25, 1991, now abandoned.

BACKGROUND OF THE INVENTION

The present invention relates to a food package of the type used to contain and display various food products, while being adapted for microwave or conventional oven cooking of the food product contained therein.

It is conventional practice to display meat, poultry, and certain other food products in individual packages which comprise a supporting tray with an absorbent pad of tissue-like paper wadding in the bottom of the tray to absorb any juices or liquids exuded from the food product. A transparent outer plastic wrapping is also usually employed to cover and surround the food product and tray to complete the package.

In an effort to extend the shelf-life of such food products, various and sundry absorbent pads have been proposed. U.S. Pat. Nos. 4,275,811 and 4,321,997 to Miller disclose an absorbent pad which has been particularly successful in food product packages for absorbing juices or other exuded liquids. The absorbent pad disclosed therein comprises a mat of liquid absorbent material, an upper liquid impermeable plastic sheet overlying the absorbent mat, and a perforated lower plastic sheet underlying the absorbent mat. The upper and lower plastic sheets extend beyond the absorbent mat and are sealed together to enclose the absorbent mat therebetween. When a food product is positioned upon the upper sheet of the absorbent pad, any exuded liquids will flow around the pad and enter the pad by capillary action through the perforations in the lower sheet, and the liquids will be held out of contact with the food product to thereby minimize contamination of the product and maintain its appearance and improve its shelf-life.

Many people consider it desirable to cook food products by microwave energy. It has become increasingly prevalent to cook such food products by placing the food package in a microwave and to cook the food product in the package. It is also considered desirable to cook some food products in the package in conventional ovens. Such a practice with conventional food packages encounters serious problems.

Foremost among these problems is the fact that conventional absorbent pads in such food packages have not been designed nor adapted for microwave or conventional oven cooking. For example, the plastic sheets of such absorbent pads are not able to withstand the high temperatures, e.g. 300° F. or higher, encountered in microwave or conventional cooking. Those absorbent pads which have been previously proposed for microwave cooking have been incapable of absorbing simultaneously water and juices normally exuded by such food products during display, storage and the like and the fats, oils or greases exuded by such food products during cooking thereof. With such prior microwave cooking pads, the absorption of water or other juices hinders or interferes with the absorption of the oils, fats or greases or vice versa.

Another distinct problem with prior absorbent pads is substantial or significant reverse migration of exudants. Prior absorbent pads may absorb more exudants during display, storage, etc. than they can retain during microwave cooking. Such excess exudants are then released from the absorbent pads and tend to contaminate the inside of the food package or migrate back to the food product. In certain instances, enough water or juices may be released to "boil" the food product during cooking.

SUMMARY OF THE INVENTION

It is accordingly an object of the present invention to provide a food package adapted for microwave or conventional oven cooking of the food product therein which alleviates the problems heretofore encountered.

It is another object of the present invention to provide an absorbent pad for a food package adapted for microwave or conventional cooking which will withstand the high temperatures encountered, is able to absorb water and other juices and fats, oils or greases simultaneously without hindering the absorption of the other, and in which the rate of absorption may be controlled depending upon the characteristics of the food product.

The objects of the invention are accomplished by providing a food package including a container formed of high temperature resistant materials and having a bottom wall for supporting a food product thereon. An absorbent pad is positioned on the bottom wall of the food package and is adapted to receive the food product thereon. The absorbent pad has upper and lower layers of high temperature resistant sheet material and at least one of the upper and lower layers is liquid permeable. The pad also includes an intermediate layer of absorbent material capable of absorbing water and other juices, as well as fats, oils or greases simultaneously.

The upper and lower layers of the pad are preferably secured together around their periphery to enclose the intermediate layer therebetween. The rate of absorbency of the pad may be controlled depending upon the characteristics of the food product by increasing or decreasing the liquid permeability of the outer layer or layers of the pad.

Some of the objects having been stated, other objects will appear as the description proceeds, when taken in connection with the accompanying drawings.

BRIEF DESCRIPTION OF THE DRAWINGS

FIG. 1 is a perspective view of a food package embodying the features of the present invention;

FIG. 2 is an exploded perspective view of an absorbent pad and food tray embodying the features of the present invention;

FIG. 3 is a perspective view of the pad shown in FIG. 2;

FIG. 4 is a fragmentary, enlarged perspective view of the lower layer of the pad shown in FIG. 2;

DESCRIPTION OF THE PREFERRED EMBODIMENTS

Figure 5:
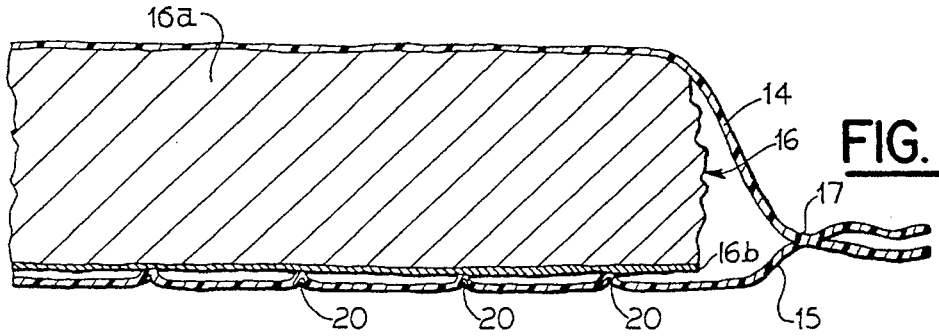
FIG. 5 is an enlarged, fragmentary sectional view taken substantially along line 5—5 in FIG. 3.

Referring more specifically to the drawings, there is shown in FIG. 1 one form of a food package 10 embodying the features of the present invention. As illustrated, food package 10 includes a tray 11 and an overwrap 12 of transparent flexible material. Tray 11, as shown in FIG. 1 and overwrap 12 are formed of suitable high temperature resistant materials capable of withstanding the temperatures normally encountered in microwave or conventional oven cooking. In the case of tray 11, one such suitable material is expanded polystyrene. Overwrap 12 may be formed of high temperature resistant plastic film, such as polyester, polyethylene terephalate, nylon, polypropylene, high density polyethylene, or release coated papers such as cellophane, silicone-coated paper or quilon-coated paper.

As shown in FIG. 2, tray 11 comprises a bottom wall 11*a*, side walls 11*b* and end walls 11*c* integrally formed to provide a receptacle for receiving and containing therein a food product F. While preferred, tray 11 is by no means the only type or form of container for the food product. Such containers may be in any form currently employed in packaging food products for display, storage, etc. For example, it is well known that food products may also be packaged in plastic film bags, molded fibrous trays or paperboard boxes.

The present invention also contemplates that the food package 10 include an absorbent pad 13 (FIG. 2) resting on the bottom wall of the container and adapted to receive the food product F thereon. The absorbent pad 13 will therefore support the food product thereon and is adapted to absorb exudants in the form of juices, water or the like exuded from the food product during display, storage, handling and also during microwave or conventional oven cooking. Absorbent pad 13 differs from conventional absorbent pads proposed for microwave cooking in that absorbent pad 13 is capable of absorbing water, juices and the like normally exuded from food products, as well as fats, oils or greases liberated or exuded from such food product during cooking thereof in food package Absorbent pad 13 comprises upper and lower layers 14 and 15 of high temperature resistant, heat sealable material. Such high temperature resistant, heat sealable material may be a suitable plastic film, such as polyester, polyethylene terephalate, nylon, polypropylene, or high density polyethylene and such film coextruded or bonded with films of other materials. At least one of the upper and lower layers 14 and 15 may preferably be a heat sealable film such as a transparent polyester film coated with polyvinylidene chloride (PVDC) copolymer such as Mylar® M-30 sold by DuPont, or a transparent polyester film coated with an amorphus polyester seal layer such as Mylar® Type 50 XM-101 also sold by DuPont. Another preferred material for the upper and lower layers is Melinex® 850H sold by ICI, which is a coextruded one side heat sealable polyester film. It should be understood that the upper and lower layers may be of different high temperature resistant materials. In fact, so long as at least one of the layers is of a high temperature resistant material and heat sealable to the other layer, the other layer may be a suitable paper, such as wet strength tissue paper or release coated papers, e.g. cellophane, silicone-coated paper or quilon-coated paper. Pad 13 further includes an intermediate layer 16 of absorbent material disposed between upper and lower layers 14 and 15. Upper and lower layers 14 and 15 extend beyond the outer periphery of intermediate layer 16 and are secured together, as for example by heat sealing, around their periphery as indicated at 17 in FIG. 5.

In the embodiment illustrated in FIGS. 2 and 5, the upper and lower layers 14 and 15 are shown as being formed of plastic film material. At least one of the upper and lower layers 14 and 15 have a plurality of perforations 20 formed therein to impart liquid permeability to the normally liquid impervious plastic film material. In this embodiment, only lower layer 15 has such perforations therein, while upper layer 14 remains liquid impervious. Accordingly, any water, juices or other exudants from the food product which would rest on upper layer 14 would flow outwardly along upper layer 14 to the edge of pad 13 and downwardly beneath the pad into contact with lower layer 15 where the liquid would pass upwardly by capillary action through the perforations 20 into the interior of pad 13 where such exudants are absorbed by the intermediate layer 16.

Intermediate layer 16 comprises a mat 16*a* of absorbent fibers, such as several layers of absorbent tissue or a relatively thick layer of wood fluff, which are relatively inexpensive and highly absorbent. When wood fluff is used, it is desirable to isolate the very short wood fluff fibers in the mat 16*a* from the perforations 20 and a layer of tissue 16*b* is therefore placed between the mat 16*a* and the lower layer 15 to act as a mechanical barrier between the perforations and the short wood fluff fibers. The tissue layer 16*b* may be any suitable layer of tissue paper, such as that commonly referred to as facial grade tissue or wet strength tissue.

The rate of absorbency of pad 13 may be controlled by varying the liquid permeability of the outer layers 14 and 15 of the pad. For example, the number, pattern and location of perforations 20 in lower layer 15 may be varied to increase or decrease permeability. The pad 13 may therefore be customized to different types of food products depending upon the characteristics of the food products and particularly the type and/or volume of exudants therefrom.

Figure 6:
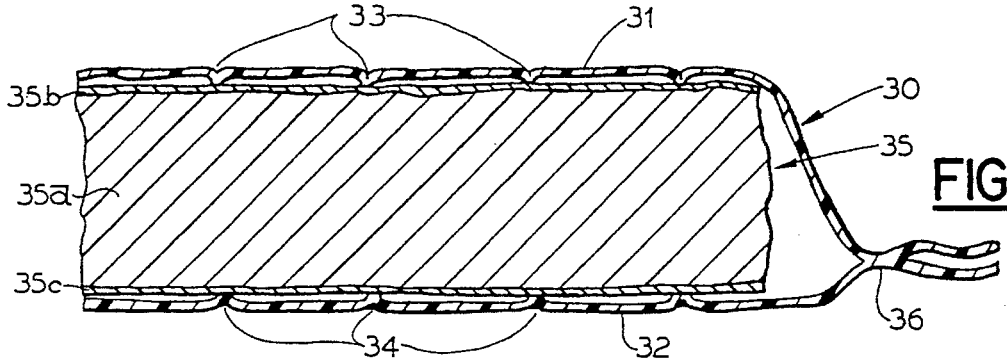
FIG. 6 is an enlarged, fragmentary sectional view similar to FIG. 5 of another embodiment of the pad of the present invention.

In this regard, there is illustrated in FIG. 6 another embodiment of the absorbent pad of the present invention referred to at 30. Pad 30 includes upper and lower layers 31 and 32 of high temperature resistant, heat sealable plastic film, such as the polyester, polyethylene terephalate, nylon, polypropylene or high density polyethylene films described above. Both of the upper and lower layers 31 and 32 have a plurality of perforations 33, 34 therein for substantially increased permeability and therefore increased rate of absorbency by pad 30.

An absorbent mat 35 is disposed between upper and lower layers 31 and 32 and the layers 31, 32 extend beyond the periphery of mat 35 and are sealed together by heat sealing, as indicated at 36. Mat 35 preferably includes a batt 35*a* of wood fluff fibers and sheets 35*b* and 35*c* of suitable tissue between the batt 35*a* and upper and lower layers 31 and 32, respectively.

Figure 7:
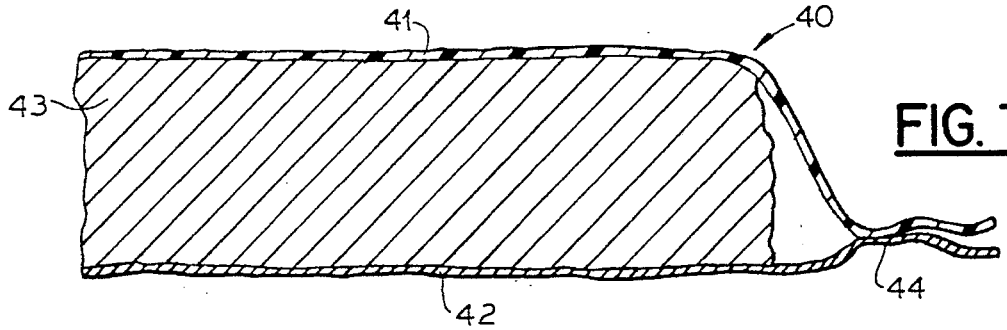
FIG. 7 is an enlarged, fragmentary sectional view similar to FIGS. 5 and 6 of yet another embodiment of the pad of the present invention.

FIG. 7 illustrates yet another embodiment of the pad of the present invention indicated generally at 40. Pad 40 includes an upper layer 41 of high temperature resistant, heat sealable plastic film and a lower layer 42 of paper, such as wet strength tissue or release coated paper, such as cellophane, silicone-coated paper or quilon-coated paper. At least, lower layer 42 should be liquid permeable so as to wick liquids into the interior of pad 40. Where release coated paper is used as lower layer 42, liquid permeability will be imparted by perforations being provided therein similar to those illustrated in the plastic film layers. No perforations are required when wet strength tissue paper is used. The rate of absorbency of pad 40 may be even further increased by providing the upper layer 41 with a plurality of perforations (not shown).

An absorbent mat 43 of wood fluff fibers, for example, is disposed between upper and lower layers 41 and 42. Upper and lower layers 41 and 42 extend beyond the periphery of mat 43 and are preferably secured together by heat sealing, as indicated at 44. Because layers 41, 42, as illustrated, are not perforated, layers of tissue paper are not required. However, if upper layer 41 is perforated, a layer of tissue paper (not shown) would be required.

Figure 8:
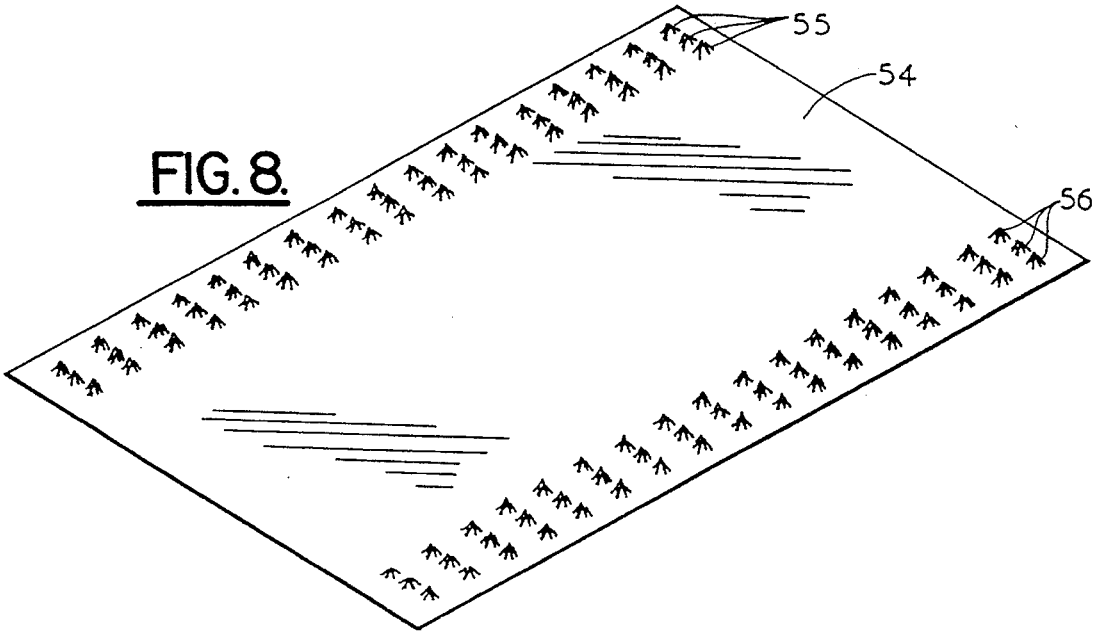
FIG. 8 is a perspective view of the lower layer of a still further embodiment of the pad of the present invention.

FIG. 8 illustrates a still further embodiment very similar to the embodiment of FIGS. 3 and 4 by showing only a lower layer 54 thereof. Layer 54 has two spaced bands of perforations 55, 56 near opposite sides thereof. Bands of perforations 55, 56 are still another way in which permeability may be varied and the rate of absorbency controlled.

While the absorbent pad of this invention has been described as being adapted for use in a food package, it should be understood that its use is not limited thereto. The absorbent pad of this invention could be used during cooking of a food product not contained in a package by placing the food product on the pad and then placing both the food product and pad in a microwave or conventional oven for cooking. In this type of use, it may be desirable to use the pad of the present invention in such a manner that the liquid permeable layer is immediate beneath the food product.

In the figures and specification, there have been disclosed preferred embodiments of the invention. While specific terms are employed, they are used in a generic and descriptive sense only, and not for the purpose of limiting the scope of the invention being set forth in the following claims.

That which is claimed is:

1. A food package adapted for microwave or conventional oven cooking of the food contained therein characterized by the capability to absorb exudants from the food during handling, shipment and storage and to absorb grease, water or both during cooking, said package comprising a container formed of high temperature resistant material for confining and displaying a food product adapted to be cooked within the container; said container including a bottom wall, and an absorbent pad disposed within said container and overlying and resting upon said bottom wall thereof, said pad comprising upper and lower layers of high temperature resistant, heat sealable sheet material and an intermediate layer of absorbent material capable of absorbing grease and water simultaneously without hindering the absorption of the other, said upper and lower layers extending beyond the periphery of said intermediate layer and being secured together around their periphery to enclose said intermediate layer therebetween, at least one of said upper and lower layers being liquid permeable whereby liquids exuded by the food product both prior to and during cooking thereof will penetrate through said permeable layer and be absorbed by said intermediate layer.

2. A food package according to claim 1 wherein said container comprises a supporting tray and an overwrap of flexible film material.

3. A food package according to claim 1 wherein said upper layer of said absorbent pad comprises high temperature resistant, heat sealable flexible plastic film material.

4. A food package according to claim 1 wherein said upper and lower layers of said absorbent pad comprise high temperature resistant flexible, heat sealable plastic film material, and at least one of said upper and lower layers having a plurality of perforations therethrough to make the same liquid permeable.

5. A food package according to claim 1 wherein said absorbent pad has the liquid permeability of said outer layer or layers controlled depending upon the amount and types of exudants to be absorbed for optimum cooking of the food product.

6. A food package according to claim 5 wherein said upper and lower layers of said absorbent pad are formed of high temperature resistant, heat sealable plastic film material, at least one of said layers having a plurality of perforations therein for imparting liquid permeability thereto, and wherein the liquid permeability of said absorbent pad is controlled by the number, size or selective placement of the perforations in said at least one layer of said pad.

7. A food package according to claim 6 wherein said at least one layer of said absorbent pad having perforations therein comprises said lower layer, and further wherein said upper layer is liquid impervious.

8. A food package according to claim 6 wherein said at least one layer of said absorbent pad comprises both of said upper and lower layers so that both outer layers of said absorbent pad are liquid permeable and the rate of absorbency of said pad is increased.

9. A food package according to claim 5 wherein at least one of said upper and lower layers of said absorbent pad is formed of paper.

10. A food package according to claim 9 wherein said upper layer of said absorbent pad is formed of high temperature resistant, heat sealable plastic film and said lower layer thereof is formed of paper.

11. A food package according to claim 1 wherein at least one layer of said absorbent pad is heat sealable film material selected from the group consisting of polyester, polyethylene terephalate, nylon, polypropylene, and high density polyethylene.

12. An absorbent pad for use in a food package adapted for microwave or conventional oven cooking of the food contained therein, said pad being characterized by the ability to absorb water and fats, oils or grease simultaneously without hindering the absorption of the other, said pad comprising upper and lower layers of high temperature resistant, heat sealable sheet material, and an intermediate layer of absorbent material for absorbing water and fats, oils or greases simultaneously, said upper and lower layers extending beyond the periphery of said intermediate layer and being secured together around their periphery to enclose said intermediate layer therebetween, and at least one of said upper and lower layers being liquid permeable whereby liquids exuded by a food product prior to and during microwave cooking will penetrate through said permeable layer and be absorbed by said intermediate layer.

13. An absorbent pad according to claim 12 wherein said absorbent pad has its rate of absorbency controlled by controlling the liquid permeability of said liquid permeable layer dependent upon the amount and types of exudants to be absorbed for optimum microwave cooking of the food product.

14. An absorbent pad according to claim 13 wherein said upper layer is formed of high temperature resistant, heat sealable liquid impervious material, and wherein said lower layer is liquid permeable.

15. An absorbent pad according to claim 14 wherein said lower layer is formed of normally liquid impervious material and has a plurality of perforations therein to make said lower layer liquid permeable and wherein the permeability thereof is controlled by the number, size or selective placement of the perforations.

16. An absorbent pad according to claim 15 wherein said upper and lower layers are formed of heat sealable plastic film material.

17. An absorbent pad according to claim 15 wherein at least one of said upper and lower layers is formed of release coated paper.

18. An absorbent pad according to claim 15 wherein said upper layer also has a plurality of perforations therein to increase the permeability of said absorbent pad and the rate of absorption thereof.

19. An absorbent pad according to claim 14 wherein said lower layer is formed of wet strength tissue paper for increased permeability and wicking of liquid into said pad to increase the rate of absorption thereof.

20. An absorbent pad according to claim 12 wherein at least one layer of said absorbent pad is a heat sealable film material selected from the group consisting of polyester, polyethylene terephalate, nylon, polypropylene, and high density polyethylene.

* * * * *